US005983408A

United States Patent [19]

Li

[11] Patent Number: 5,983,408

[45] Date of Patent: Nov. 16, 1999

[54] GUARD DEVICE FOR SPORTS

[76] Inventor: Kao-Ming Li, No. 1-14, Ma Dow Kou, Ma Kou Li, Ma Dow Chen, Tainan Hsien, Taiwan

[21] Appl. No.: 09/081,058

[22] Filed: May 19, 1998

[51] Int. Cl.[6] ..... A41D 9/02

[52] U.S. Cl. ..... 2/455; 2/16; 2/22

[58] Field of Search ..... 2/16, 20, 159, 2/160, 161.1, 162, 455; 473/59, 62

[56] References Cited

U.S. PATENT DOCUMENTS

| | | | |
|---|---|---|---|
| 1,253,260 | 1/1918 | Levinson | 2/462 |
| 5,207,430 | 5/1993 | Goins | 273/189 |
| 5,222,256 | 6/1993 | Wang | 2/24 |
| 5,594,954 | 1/1997 | Huang | 2/24 |
| 5,600,849 | 2/1997 | Hu | 2/16 |
| 5,813,050 | 9/1998 | Popowski | 2/16 |

*Primary Examiner*—Diana Oleksa
*Assistant Examiner*—Kate M. Moran
*Attorney, Agent, or Firm*—Bacon & Thomas

[57] ABSTRACT

A guard device is provided an outer surface of a sports guard. The guard device includes a substrate, a first resilient arcuate plate projecting from the substrate and having a first distal end with an inner end edge which faces the substrate, arid a second resilient arcuate plate projecting from the substrate toward the first arcuate plate and having a second distal end which contacts the inner end edge of the first distal end of the first arcuate plate. The curvature of the second arcuate plate has a vertex which has a distance to the substrate longer than a distance between the first distal end of the first arcuate plate of the substrate.

1 Claim, 6 Drawing Sheets

GUARD DEVICE FOR SPORTS

BACKGROUND OF THE INVENTION

1. Field of the Invention

The present invention relates to a guard device for sports.

2. Description of the Related Art

A wide variety of guard devices have heretofore been provided to protect the sportsmen from being injured. Examples of the guard devices are: U.S. Pat. No. 5,339,465 to Kyewski, issued on Aug. 23, 1994; U.S. Pat. No. 5,435,007 to Kalvestran et al., issued on Jul. 25, 1995; and U.S. Pat. No. 5,445,566 to Hayes, issued on Aug. 28, 1995. U.S. Pat. No. 5,566,389 issued to Applicant on Oct. 22, 1996 discloses a shock absorbing wrist guard which includes a soft piece comprising two ear portions, a loop pile area connected on a portion of the soft piece, an envelope connected to another portion of the soft piece and defining a plurality of slots therein, a mediate portion between the loop pile area and the envelope, an opening defined in the space portion allowing a thumb of a user to pass therethrough, and a soft strip extended from one side of the loop pile area, and a shock absorbing device received in the envelope for protecting the user's wrist. Nevertheless, in addition to the increased cost, the shock-absorbing effect of the wrist guard is found insufficient or not uniform in some cases.

The present invention is intended to provide an improved guard device which mitigates and/or obviates the above-mentioned problems.

SUMMARY OF THE INVENTION

It is a primary object of the present invention to provide a guard device for sports which can be used to safeguard fragile portions, e.g., wrists, knees, elbows, etc., of the human body in sporting activities.

The present invention provides a guard device mounted to an outer surface of a sports guard. The guard device comprises a substrate, a first resilient arcuate plate projecting from the substrate and having a first distal end with an inner end edge which faces the substrate, and a second resilient arcuate plate projecting from the substrate toward the first arcuate plate and having a second distal end which contacts the inner end edge of the first distal end of the first arcuate plate. The curvature of the second arcuate plate has a vertex which has a distance to the substrate longer than a distance between the first distal end of the first arcuate plate of the substrate.

By such a provision, a two-stage shock-absorbing effect can be obtained o effectively absorb impact to the sports guard and the portion of the human body to be protected.

Other objects, advantages, and novel features of the invention will become more apparent from the following detailed description when taken in conjunction with the accompanying drawings.

DESCRIPTION OF THE PREFERRED EMBODIMENT

Figure 1:
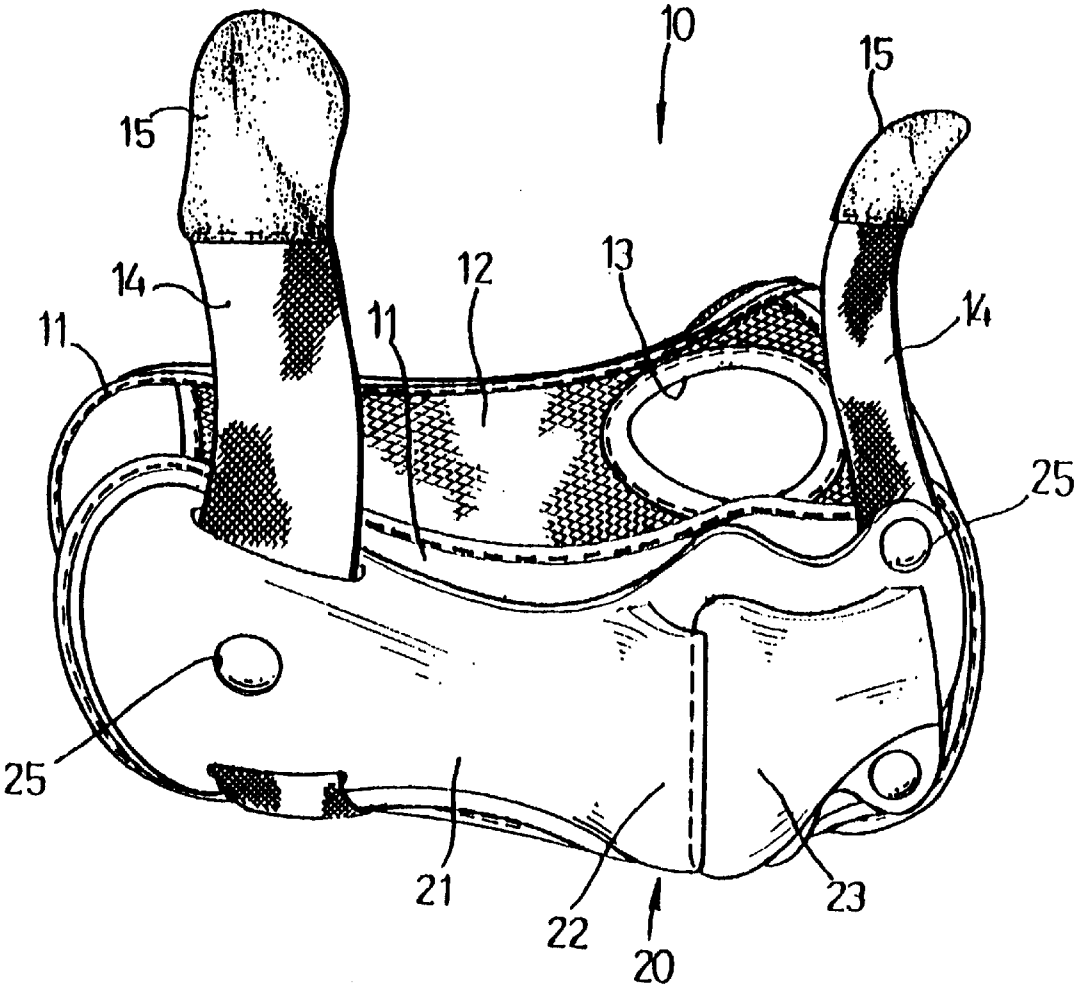
FIG. 1 is a perspective view of a wrist guard with a guard device in accordance with the present invention.
Figure 2:
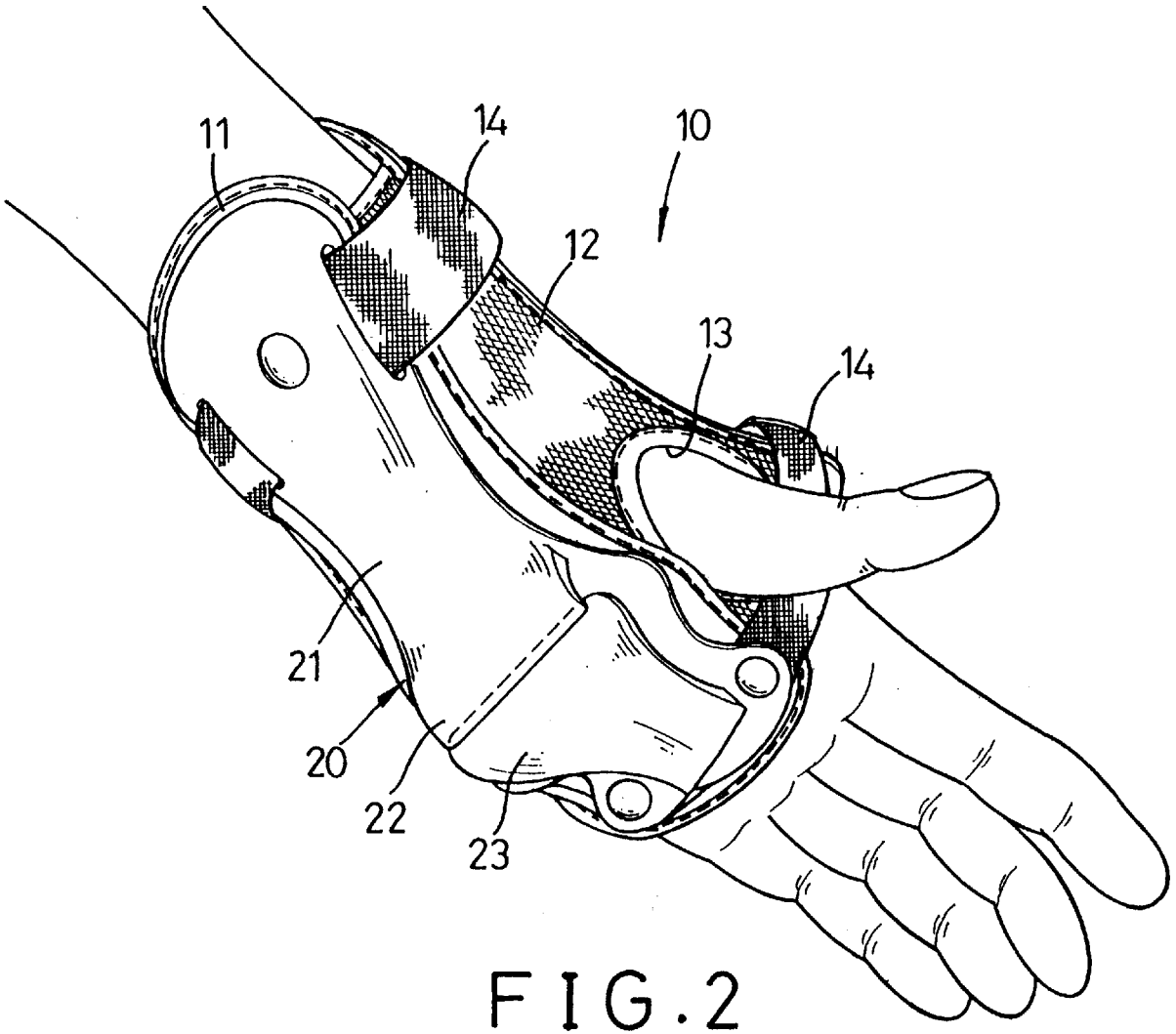
FIG. 2 is a perspective view of the wrist guard in use.

The present invention provides a guard device for sportsmen to safeguard the wrists, knees, elbows, and the like. Referring to the drawings and initially to FIGS. 1 to 4, the guard device of the present invention is designated by "20" and provided to a wrist guard 10. As shown in FIG. 1, the wrist guard 10 includes upper and lower pads 11, and two resilient knitted net 12 each of which is mounted between the pads 11 and which are extended at lateral sides of the wrist guard 10, respectively. A thumbhole 13 is defined in one of the nets 12 such that the thumb of the user's hand is passable. Two straps 14 (each having an end 15 for fastening) are secured to the wrist guard 10 by rivets 25, which is conventional and therefore not further described. In use, the thumb of the user extends through the hole 13 and the remaining fingers are exposed outside the wrist guard 10, as shown in FIG. 2.

The guard device 20, which is the feature of the invention, is provided to, e.g., the lower pad 11. The guard device 20 includes a substrate 21 preferably integral with the lower pad 11, a first resilient arcuate plate 22 projecting from the substrate 21 and having a first distal end 220, and a second resilient arcuate plate 23 projecting from the substrate 21 toward the first arcuate plate 22 and having a second distal end 230 which contacts a inner end edge 220*a* (or the inner side) of the first distal end 220 of the first arcuate plate 22. The curvature of the second arcuate plate 23 has a vertex which has a distance to the substrate 21 longer than a distance between the first distal end 220 of the first arcuate plate 22 and the substrate 21.

Figure 3:
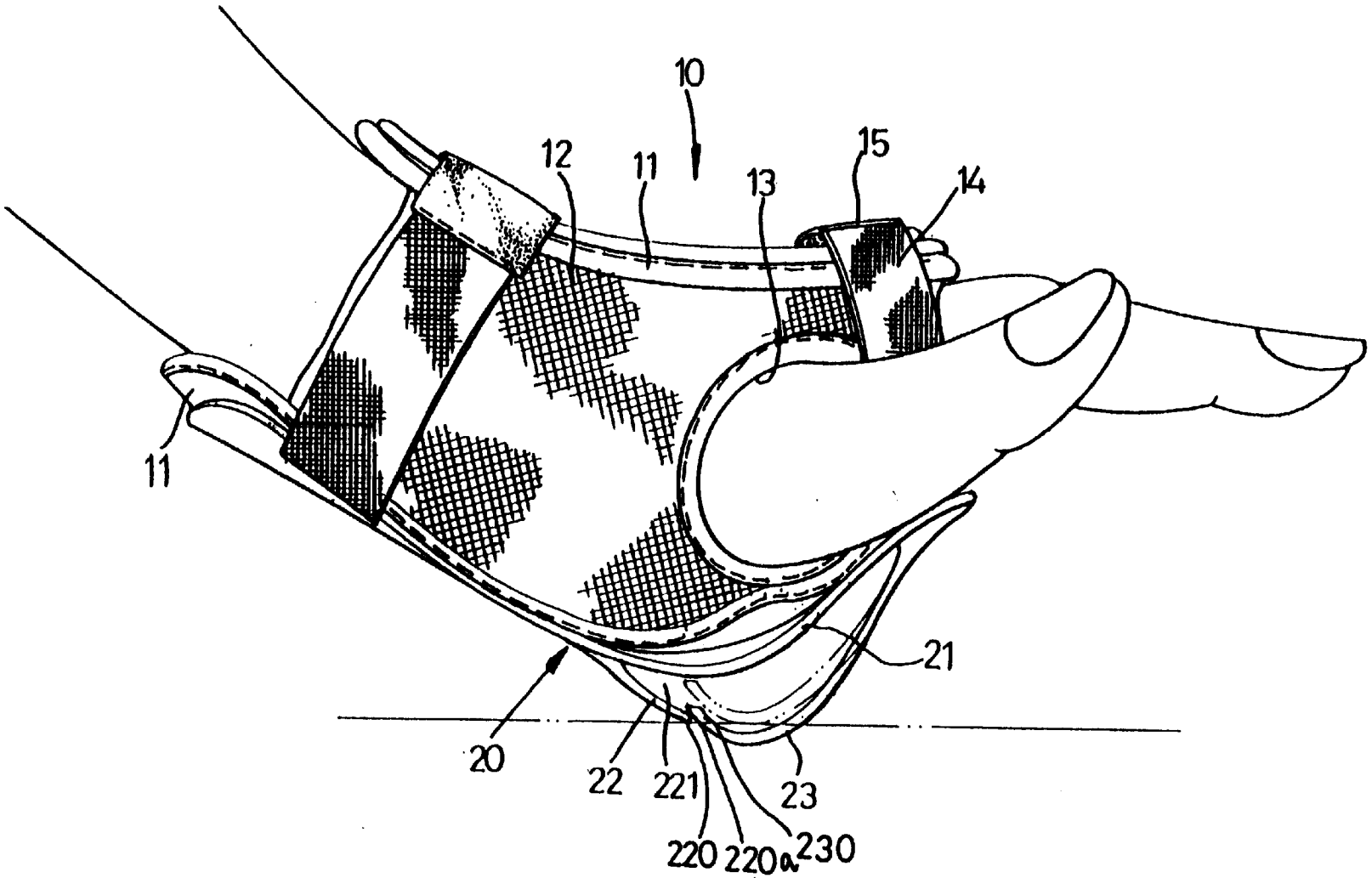
FIGS. 3 and 4 are side views illustrating operation of the guard device.
Figure 4:
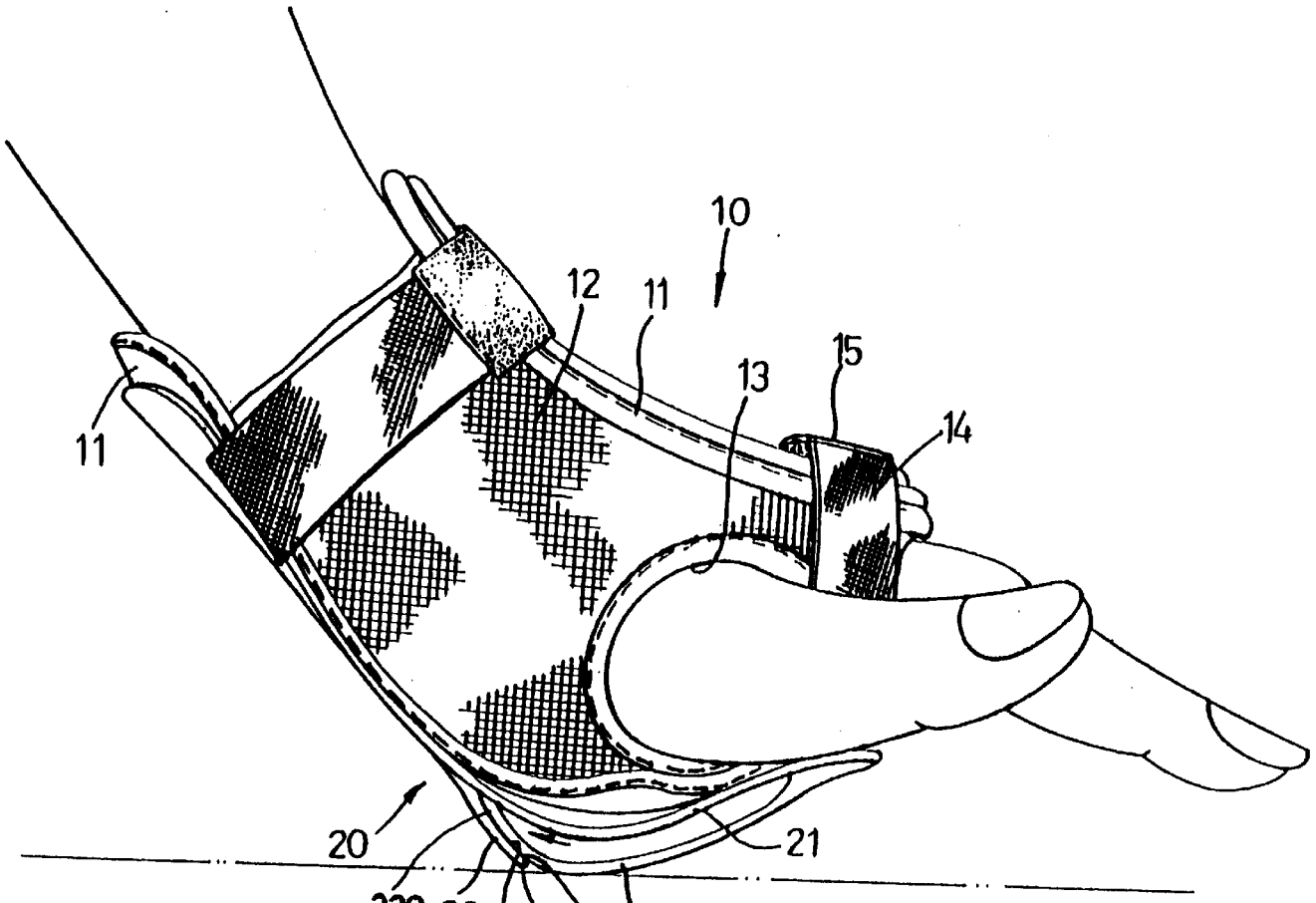

In use, referring to FIG. 3, when the guard device 20 touches, e.g., the ground (the horizontal phantom line), the second arcuate plate 23 is deformed to a position shown by the phantom lines to absorb the impact. When the impact is relatively large, the second arcuate plate 23 can be deformed to a position shown in FIG. 4 in which the second distal end 230 of the second arcuate plate 23 touches an inner end of the first arcuate plate 22. Due to the further deformation of the second arcuate plate 23, the relatively large impact (which is occurred when touching the ground) can be effectively absorbed. As a result, no impact is transmitted to the wrist guard 10 and the wrist of the user under provision of the two-stage impact-absorbing arrangement as a space 221 (FIG. 3) for the two-stage impact absorption is defined in the guard device.

Figure 5:
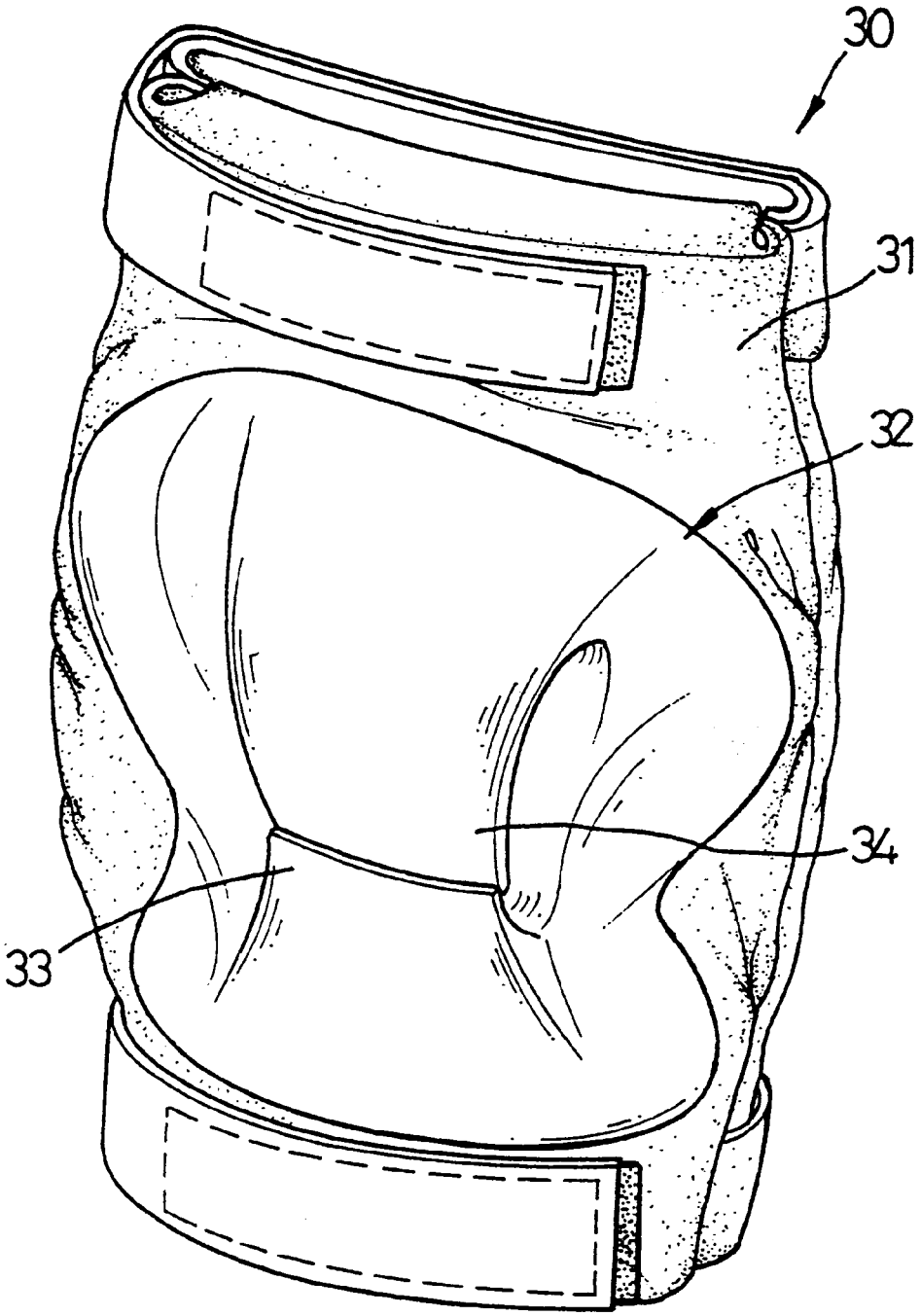
FIG. 5 is a perspective view of a knee guard with the guard device of the present invention.
Figure 6:
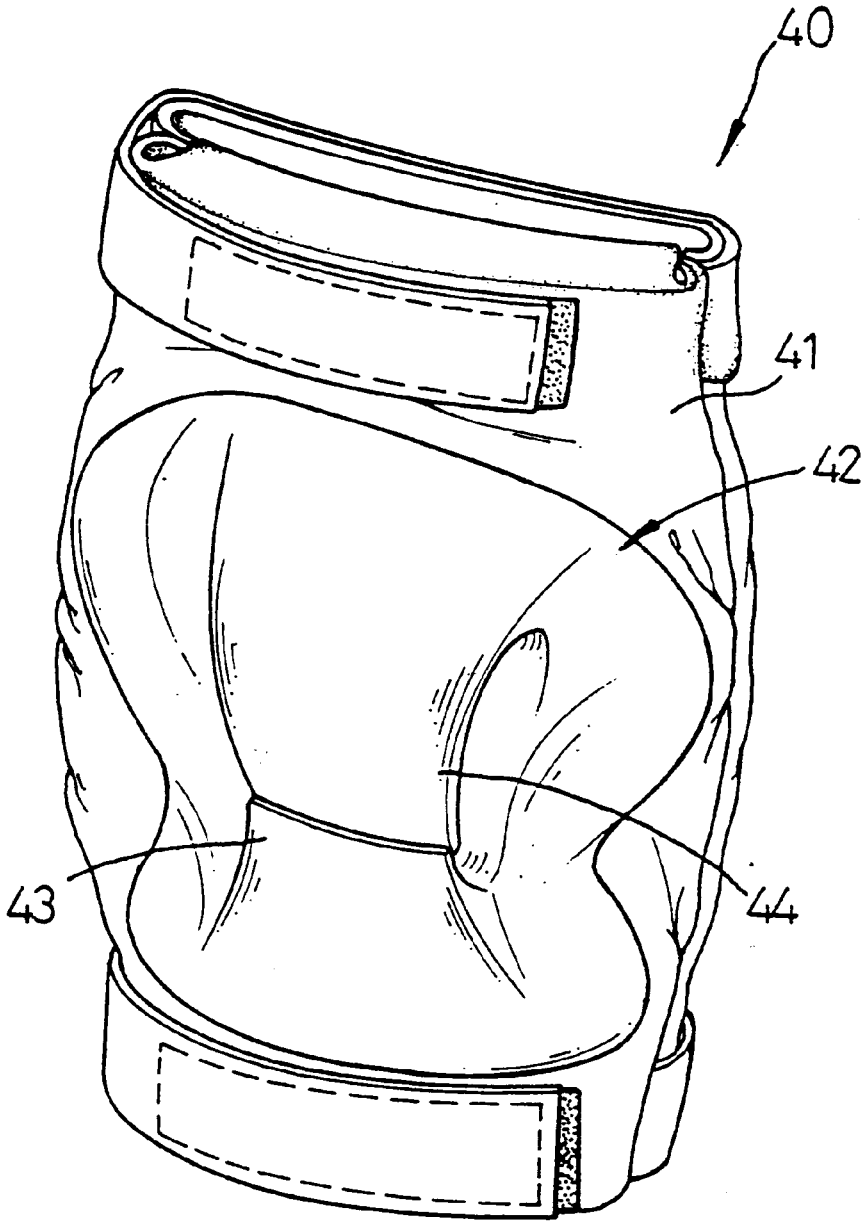
FIG. 6 is a perspective view of an elbow guard with the guard device of the present invention.

Referring to FIG. 5, the guard device is applied to an outer side 31 of a knee guard 30. Similarly, the guard device includes a substrate 32, a first arcuate plate 33, and a second arcuate plate 34, all of which are identical to those disclosed in the first embodiment. Referring to FIG. 6, the guard device can also applied to an outer side 41 of an elbow guard 40. Similarly, the guard device includes a substrate 42, a first arcuate plate 43, and a second arcuate plate 44, all of which are identical to those disclosed in the first embodiment.

According to the above description, it is appreciated that the present invention provides an improved guard device with two-stage absorbing effect to effectively absorb impact.

Although the invention has been explained in relation to its preferred embodiment, it is to be understood that many other possible modifications and variations can be made without departing from the spirit and scope of the invention as hereinafter claimed.

What is claimed is:

1. A guard device adapted to be mounted to an outer surface of a sports guard, the guard device comprising:

a substrate, a first resilient arcuate plate projecting from the substrate and having a first distal end with an inner end edge which faces the substrate, and a second resilient arcuate plate projecting from the substrate toward the first arcuate plate and having a second distal end which contacts the inner end edge of the first distal end of the first arcuate plate, a curvature of the second arcuate plate having a vertex, and a distance from the vertex to the substrate being longer than a distance between the first distal end of the first arcuate plate and the substrate, wherein an impact on the second arcuate plate causes said distal end of the second resilient arcuate plate to bend inwardly towards said substrate and away from said inner end edge of the first distal end of the first resilient arcuate plate.

* * * * *